United States Patent [19]

Lierke et al.

[11] 4,402,458

[45] Sep. 6, 1983

[54] APPARATUS FOR ATOMIZING LIQUIDS

[75] Inventors: Ernst-Guenter Lierke, Schwalbach; Wolfgang Heide, Darmstadt; Rudolf Grossbach, Camberg; Karl Floegel, Friedrichsdorf; Hartmut Erdmann, Steinbach, all of Fed. Rep. of Germany

[73] Assignee: Battelle-Institut e.V., Frankfurt am Main, Fed. Rep. of Germany

[21] Appl. No.: 249,138

[22] Filed: Mar. 30, 1981

[30] Foreign Application Priority Data

Apr. 12, 1980 [DE] Fed. Rep. of Germany ..... 3014142

[51] Int. Cl.[3] ..... B05B 17/06; B05D 1/02

[52] U.S. Cl. ..... 239/102; 239/132; 239/135; 310/330

[58] Field of Search ..... 239/4, 101, 102, 108, 239/132, 135; 261/DIG. 48; 310/311, 321, 323–325, 330

[56] References Cited

U.S. PATENT DOCUMENTS

| | | | |
|---|---|---|---|
| 3,283,182 | 11/1966 | Jones et al. | 310/325 |
| 3,292,910 | 12/1966 | Martner | 239/102 X |
| 3,756,575 | 9/1973 | Cottel | 239/102 X |

FOREIGN PATENT DOCUMENTS

| | | | |
|---|---|---|---|
| 2137083 | 2/1973 | Fed. Rep. of Germany | 239/102 |
| 2906823 | 9/1980 | Fed. Rep. of Germany . | |
| 695691 | 11/1979 | U.S.S.R. | 239/102 |

OTHER PUBLICATIONS

"Ultrasonic Atomizer Incorporating a Self Acting Liquid Supply", Lierke, E. G., *Ultrasonics*, Oct. 1967, pp. 214–218.

*Primary Examiner*—Andres Kashnikow
*Attorney, Agent, or Firm*—Fisher, Christen & Sabol

[57] ABSTRACT

Apparatus for atomizing liquids which includes an ultrasonic excitation system, a bending resonator which oscillates at ultrasonic frequencies, and a device for the delivery of liquid into the velocity nodal region of the bending resonator. The bending resonator has at least one surface which is inclined with respect to the axis of the excitation system. The bending resonator can be in the form of an elongated narrow strip having a plurality of parallel nodal lines. The length of the excitation system is approximately $(2n+1)\ \lambda/4$, wherein n is 0 or an integer.

34 Claims, 31 Drawing Figures

FIG. 8a
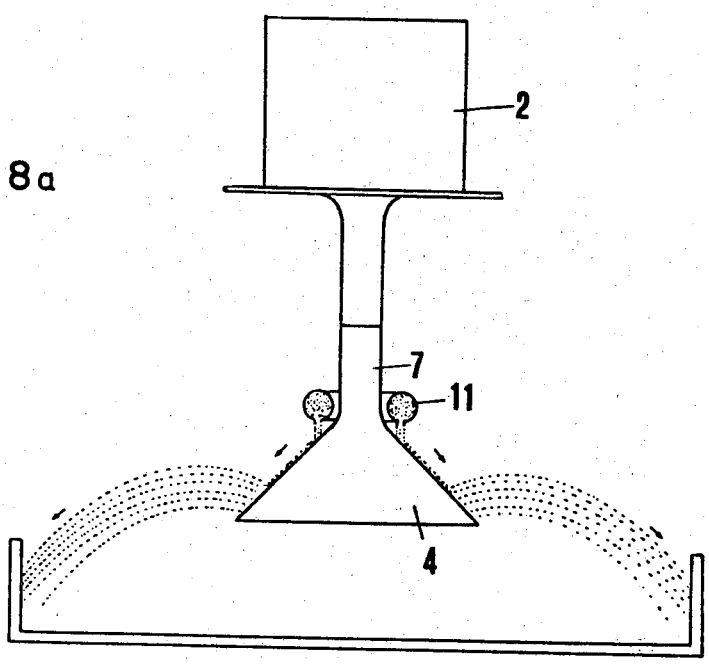
FIG. 8b
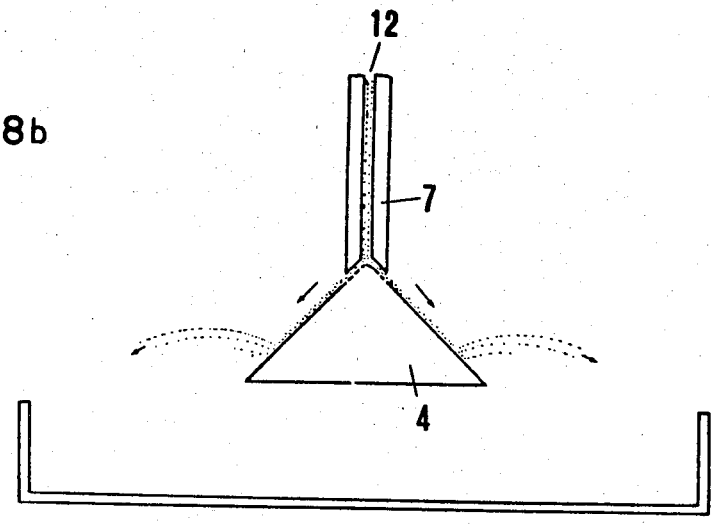
FIG. 8

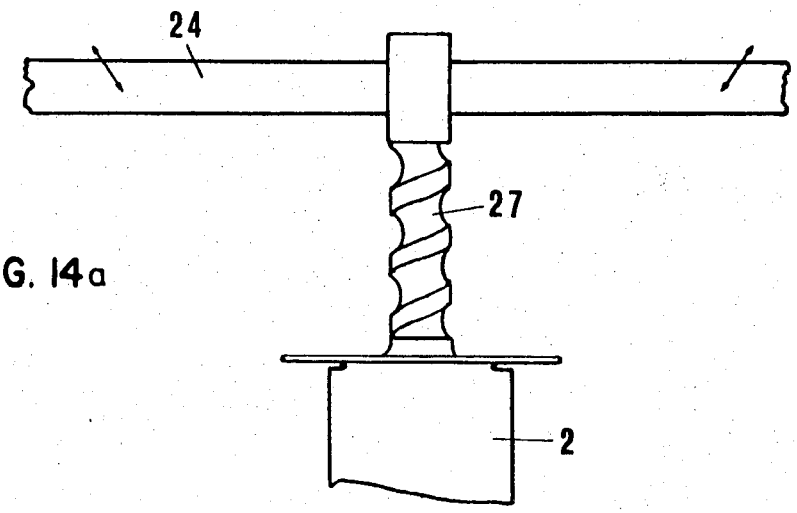
FIG. 14a
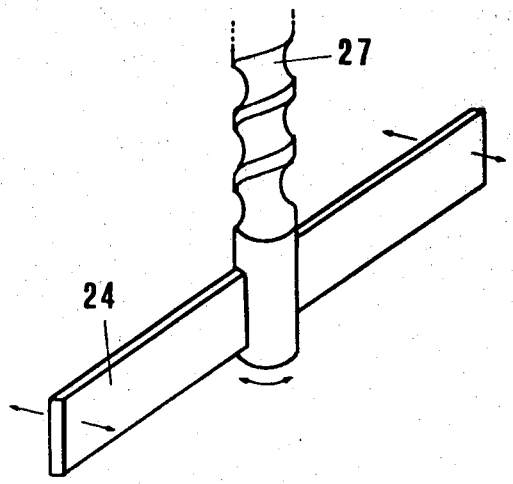
FIG. 14b
FIG. 14

APPARATUS FOR ATOMIZING LIQUIDS

BACKGROUND OF THIS INVENTION

1. Field of This Invention

This invention relates to apparatus for atomizing liquids. This invention more particularly relates to apparatus for atomizing liquids which substantially comprises an ultrasonic excitation system, a bending resonator which oscillates at ultrasonic frequencies, and means for the delivery of liquid into the velocity nodal region of the bending resonator.

2. Prior Art

In conventional ultrasonic capillary wave atomizers, the fine dispersion effect is produced by cutting off drops from a stationary capillary wave grid with nodal lines which are arranged in a chessboard-like manner—the grid being formed on a thin film of liquid which is excited by the surface of an oscillating solid body. The atomization effect requires an excitation amplitude, which is dependent on the frequency and various parameters of the liquid, in respect of the oscillating solid body surface, and a suitable thickness of the film of liquid. If the film is excessively thin, drops cannot be formed; while if the film is excessively thick, damping prevents effective capillary waves from being stimulated in the liquid.

In order to achieve the optimum specific atomization through-put in relation to surface area (of a few liters per hour and $cm^2$) with low-viscosity liquids, the liquid must be continuously fed onto the atomizer surface in such a way as to maintain the optimum possible thickness of film over the maximum area of the oscillating surface.

With the conventional mode of supplying the liquid through an axial bore in the ultrasonic atomizer, the required manner of operation can be achieved only up to relatively low levels of through-put of less than 5 liters per hour. However, when an internal liquid supply arrangement of such kind is used, cavitation sputtering occurs, particularly at higher rates of through-put. Cavitation sputtering results in unacceptable impairment of the drop spectrum. Such effect can be prevented by using an external liquid supply arrangement involving a plurality of pipes. Such a construction may be uneconomical and may not be the optimum arrangement under some circumstances, at high rates of through-put. Added to this is the fact that the known apparatuses do not make it possible to effect separation into different particle sizes, for example, when producing powder.

BROAD DESCRIPTION OF THIS INVENTION

An object of this invention, based upon overcoming the prior art problems, is to provide an apparatus which overcomes the disadvantages of known apparatuses. Another object of this invention is to provide an apparatus which achieves atomization of a greater amount of liquid per unit of time, at an optimum level of efficiency. A further object of this invention is to provide an apparatus which ensures that the delivery of liquid is cavitation-free and that the power consumption is at the minimum possible level. Other objects and advantages of this invention are set out herein or are obvious herefrom to one ordinarily skilled in the art.

The objects and advantages of this invention are achieved by the apparatus of this invention.

It has been found that the prior art problems can be solved by providing the bending resonator with at least one surface which is inclined with respect to the axis of the excitation system, and by assuring that the length of the excitation system is approximately $(2n+1)\ \lambda/4$, wherein n is 0 or an integer. The underlying apparatus for atomizing liquids is substantially comprised of an ultrasonic excitation system, a bending resonator which oscillates at ultrasonic frequencies, and means for the delivery of liquid into the velocity nodal region of the bending resonator.

Preferably the bending resonator is in the form of a hollow cone. Preferably the length of the excitation system is $\lambda/4$ and the bending resonator is formed by a narrow aperture in the cylindrical portion of the excitation system. More preferably the width of the aperture is $(2n+1)\ \lambda_{air}/4$, wherein n is 0 or an integer. The bending resonator is preferably in the form of a hollow pyramid. Also, the bending resonator preferably has two surfaces which are at an angle relative to each other and the liquid can be supplied along the end at which the surfaces intersect.

A heating means for the resonator, for example, most preferably an induction coil, is preferably provided for atomization of melts, and a cooling section is preferably provided between two adjacent velocity nodal regions of the cylindrical slender portion of the axial excitation system. Preferably the liquid to be atomized can be delivered axially in a jet on to the tip of the resonator.

Preferably, for the purposes of delivery of the liquid, the excitation system has an axial bore wherein a tube which is tuned to resonance is passed through the bore and secured to the resonator in the velocity nodal region, and the tip of the bending resonator is rounded off in the region of the opening. Preferably the tip of the bending resonator is provided with a bore and can be fixed by means of a mounting member, and the liquid delivery means is disposed concentrically around the mounting member. The cylindrical slender portion of the excitation system preferably fits onto the tip of the resonator from the outside. Also preferably, for the delivery of the liquid, the excitation system has an axial bore which is provided with liquid outlet openings in the transitional zone between the excitation system and the resonator. Further preferably, for the delivery of the liquid, an annular pipe is provided in the transitional zone between the resonator and the excitation system, the annular pipe having a plurality of liquid outlet openings.

In accordance with a further embodiment of this invention, the bending resonator is in the form of an elonated narrow strip having a plurality of parallel nodal lines. The overall length of the excitation system can in this case be n $\lambda/2$, having a velocity antinode at the intersection to the bending resonator. The underlying apparatus for atomizing liquids is substantially comprised of an ultasonic excitation system, a bending resonator which oscillates at ultrasonic frequencies, and means for the delivery of liquid into the speed nodal regions of the bending resonator.

Preferably any desired inclination of the normal to the surface of the bending resonator, and thus the atomization direction, can be set by varying the axial direction of the excitation system. The normal to the surface of the resonator, and thus the atomization direction, preferably is perpendicular to the axis of the excitation system, and the slender cylindrical portion of the excitation system preferably is at least partly in the form of a spiral so that the axial oscillation of the excitation system is converted into a torsional component. Also preferably liquid delivery means to the nodal lines are provided on both sides of the resonator. An edge of the bending resonator is provided, at the velocity nodes, with extension portions which dip into a liquid reservoir so that the liquid is transferred onto the resonator surface for atomization thereof, by an acoustic pump effect. A plurality of atomizers preferably is secured to a common liquid supply conduit, for example, most preferably, in a linear or circular arrangement. Preferably, a plurality of identical bending resonators with a common excitation system is connected together in a cascade-type formation and the cascade elements are coupled in the velocity antinodes or torsional velocity antinodes. Preferably each section of the cascade formation includes spiral elements. Also preferably, the resonators in the cascade formation are arranged at different angular positions relative to each other.

The apparatus of this invention comprises a conventional ultrasonic amplitude transformer and a bending resonator which is mechanically connected thereto and which has the same resonance frequency. The connection between the two parts can be such that the bending resonator can be replaced by a separate unit. In the simplest case, the resonator is a radially symmetrical hollow cone or an elongate metal strip.

The bending oscillation of the resonator is produced by an axial excitation system. The excitation system is preferably a piezoelectrically excited compound oscillator which can be in the form of a step or tapped transformer or with a conical, exponential or similar contour. However, the axial excitation effect can also be partially converted into a torsional component, whereby, with a suitable design, bending oscillation of the linear resonator is also produced.

The ultrasonic atomizer of this invention can be used in particular in air humidifiers, in air conditioning equipment, in oil burners, as metal atomizers for producing powder from atomized melts, and as atomizers for atomizing solutions, suspensions and emulsions for producing powder by evaporation of the liquid components. It can also be used in process chambers at reduced or increased gas pressure, at lower or higher temperatures, and in inert or reactive gas atmospheres, so that it is possible to conceive of a large number of technical uses in processes on an industrial scale, because of the high output which can be achieved with minimum power consumption. In the latter use, in particular gasification or degasification of liquids is achieved by a diffusion effect. In this respect, adjustment of the angle of the atomization surface makes it possible for the particles of liquid to cover a long flight path so that the entire volume of the process chamber can be put to optimum use.

The advantages which are achieved by this invention are essentially that large amounts of liquid can be conveyed to the atomizer surface by way of a central supply means, under optimum conditions. In addition, cavitation is eliminated at the liquid supply locations in spite of the fact that the film of liquid initially is of great local thickness. Due to the parabolic characteristic of the cloud of liquid, the distances between the droplets continuously increases so that the usual tendency of a dense could to coagulate is greatly reduced. Due to the increase in the diameter of the trajectory of the droplets, with the square of the diameter of the droplets, it is possible to effect particle separation in the production of powders. The inclined position of the atomizer surface provides that over-critical damping of the atomizer oscillation is prevented. The excess liquid flows away over the edge of the atomizer without detrimentally affecting the function thereof.

Surfaces of any desired width may be uniformly sprinkled with the atomized liquid by the strip-like bending resonator being of suitable length. It is possible to double the output, by providing for a supply of liquid on both sides.

By using a conical bending wave atomizer with a diameter of 50mm, for example, with a working frequency of 20 kHz and with a HF-power consumption of less than 10 watts, about 150 liters per hour of water can be atomized in drops of 40 $\mu$m. A larger cone surface area makes it possible to considerably increase the output which can be reduced to zero by reducing the supply of liquid, without changing the diameter of the drops. In addition, the apparatus of this invention can be used without difficulty at frequencies of up to about 100 kHz. Accordingly, this results in the mean drop diameters being smaller, with almost the same specific outputs in relation to surface area, of some liters per hour and per $cm^2$.

DESCRIPTION OF THE DRAWINGS

This invention is described in greater detail below, with reference to the accompanying diagrammatically-simplified drawings in which:

FIGS. 8*a* and 8*b* show various alternative forms of the means for supplying the liquid in an apparatus in which the cone is in a reversed position;

FIGS. 14*a* and 14*b* show two further embodiments wherein the bending oscillations of the resonator are produced by torsional excitation;

DETAILED DESCRIPTION OF THE INVENTION

Figure 1:
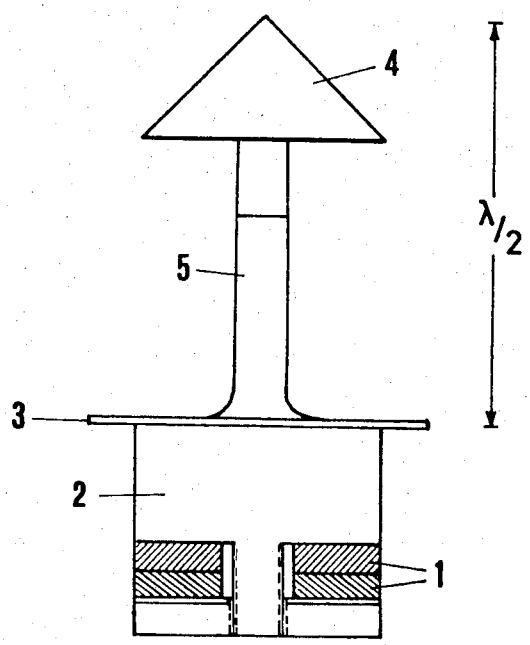
FIG. 1 shows a general view of an embodiment of the atomizer according to this invention, with a hollow cone as the bending resonator.

In the embodiment shown in FIG. 1, the ultrasonic atomizer according to this invention has coupling oscillator 2 which is excited by means of two piezoelectric ceramic discs 1 and which is in the form of an ampliture transformer that is stepped at velocity node 3. Such oscillators are described for example in DOS (German laid-open application) No. 2,906,823. In this embodiment bending resonator 4 is in the form of a rotationally symmetrical hollow cone and is disposed at the end, which is remote from step 3, of slender cylindrical portion 5 of the excitation system. According to this invention the overall length of such an excitation system can be $(2n+1)\lambda/4$, wherein n is 0 or another integer. In the embodiment shown in FIG. 1 the length is $3\lambda/4$, wherein the distance between step 3 and the tip of resonator 4, that is, the length of cylindrical narrower portion 5, is $\lambda/2$ so that a velocity nodal point is disposed in the region of the tip of the cone. The dimensions of resonator 4, that is, the thickness, diameter and taper angle of the cone, are so selected that, at the desired working frequency, bending resonances are produced with a greater or smaller number of nodal radii and/or nodal circles. Preferably the resonance used is a natural resonance at which resonator 4 oscillates with nodal radii and at an amplitude which increases from the center, that is, the tip of the cone, to the periphery so that the liquid which is directed onto the tip of the cone can spread out towards the peripheral region with the thickness of the film of liquid decreasing.

Figure 2A:
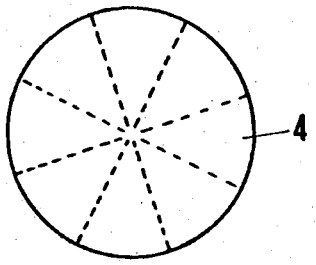
FIGS. 2*a* and 2*b*, respectively, show a plan view and a view in longitudinal section of the conical bending resonator.
Figure 2B:
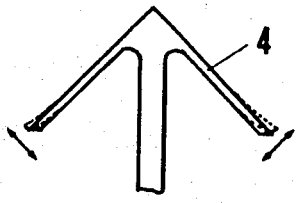

FIG. 2*a* shows the nodal radii in plan view, while FIG. 2*b* shows the bending oscillation of hollow cone resonator 4.

Figure 3:
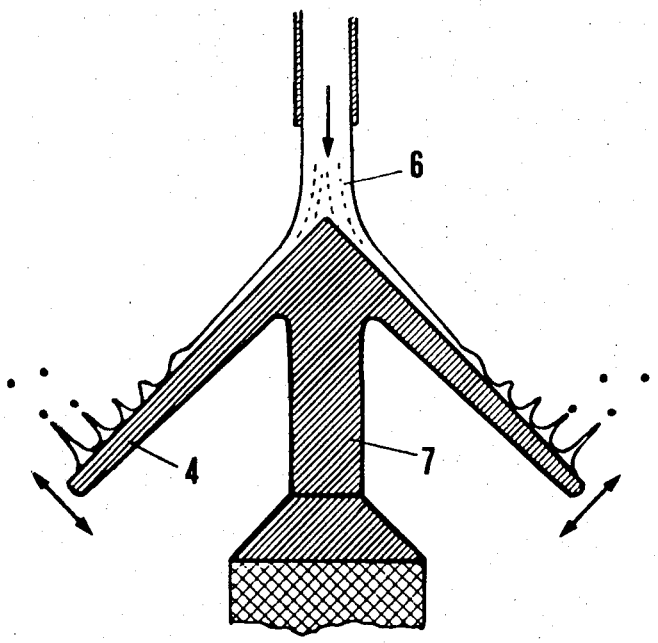
FIG. 3 shows a view in longitudinal section through the conical resonator according to this invention, with a vertical supply of liquid.

FIG. 3 shows that liquid 6 to be atomized can be supplied axially onto the tip of resonator 4 from above, in the form of a relatively thick jet or stream. As there is a velocity node in the region of the tip of hollow cone 4, there is no stimulation of capillary waves at that point. There also cannot be any oscillation cavitation, as would be the case with a thicker film of liquid, at the amplitudes required for producing the atomization effect. Accordingly, the liquid runs down over the surface of the cone without interference, while the thickness of the film steadily decreases with increasing distance from the center, with the amplitude of the movement of the atomizer increasing at the same time. This automatically results in the film being of optimum thickness for the atomization action. Atomization is then effected in conventional manner by droplets being cut off from the capillary wave grid. The angle of inclination of the surface of the cone causes the droplets to be thrown axially symmetrically away from the atomizer, following approximately parabolic trajectories whose distance from the center is approximately proportional to the amplitude $\nu$ of the transducer, the density $\rho$ of the atomized liquid and the square of the droplet diameter d. The mean droplet diameter $d_m$ follows in known manner from the following caillary wave formula: ,130 wherein $\sigma$=surface tension $\lambda_k$=capillary wave length f=frequency The droplet spectrumis described by a relatively narrow logarithmic normal distribution.

FIG. 3 also shows that resonator 4 is secured to the excitation system by way of coupling portion 7.

Figure 4:
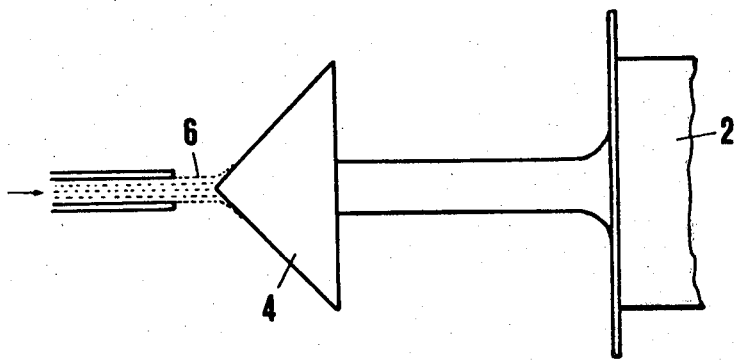
FIG. 4 shows an embodiment wherein the liquid is supplied horizontally.
Figure 5A:
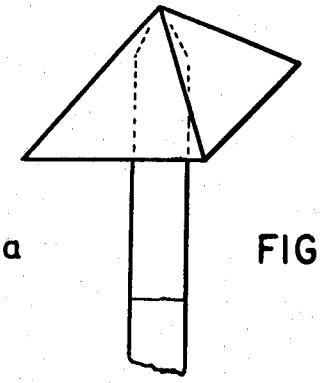
FIGS. 5*a* through 5*e* show various embodiments of the bending resonator.
Figure 5B:
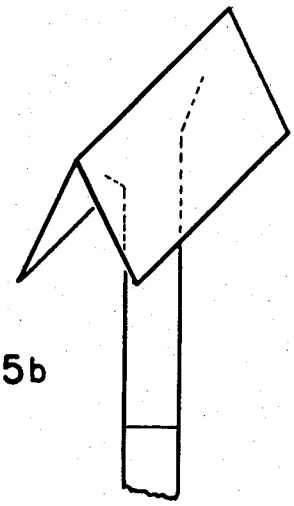
Figure 5C:
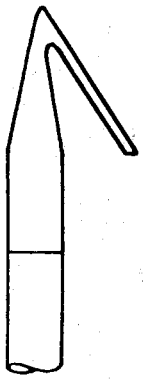
Figure 5D:
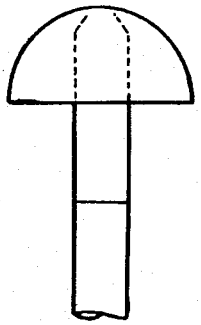
Figure 5E:
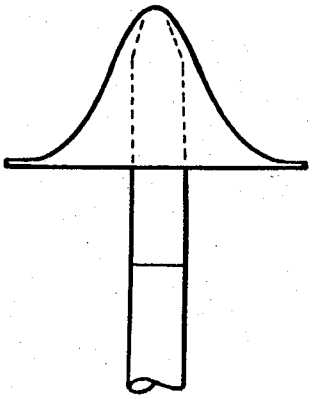

In an alternative form of the arrangement shown in FIG. 3, the liquid can also be delivered in a horizontal direction, as shown in FIG. 4.

According to this invention, upon oscillation of resonator 4 with a plurality of nodal circles, it may also be necessary for the means for the delivery of the liquid to be directed not just centrally onto the tip of the cone but also in the region of the nodal circles.

FIGS. 5*a* through 5*e* show a selection of various forms of the bending resonator. It is essential for the resonator to have at least one inclined or curved atomization surface and for the liquid to be supplied to the region of a velocity nodal point or nodal line. In the embodiment shown in FIG. 5*b* the liquid can be delivered along the common edge at which the two surfaces intersect each other, for example, through an opening of slot-like configuration.

Figure 6:
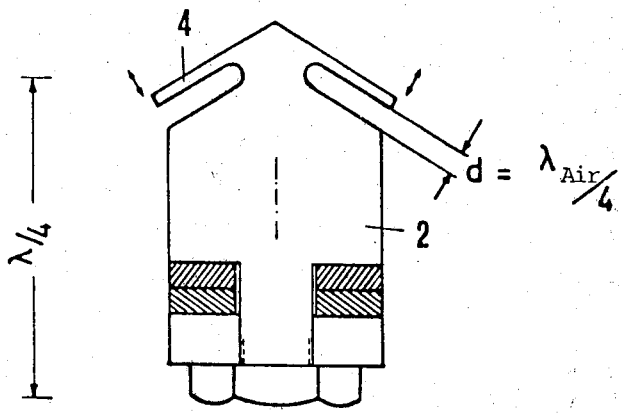
FIG. 6 shows a further embodiment wherein the conical resonator is connected to the excitation system in such a way that the overall length of the system is $\lambda/4$.

FIG. 6 shows a compact embodiment of the atomizer shown in FIG. 1 with conical bending resonator 4. In this case, the overall length of the excitation system is $\lambda/4$ (n=0) so that there is a velocity node at the tip of resonator 4. This embodiment is preferred because it can be produced relatively simply by means of an aperture in the cylindrical excitation system. In order to prevent the reflection of air-borne sound to the rear of resonator 4 (it would consume unnecessary power), the width of the aperture, that is, the distance between the peripheral end of cone 4 and excitation portion 2, should be about $\lambda_{air}/4$.

Figure 7:
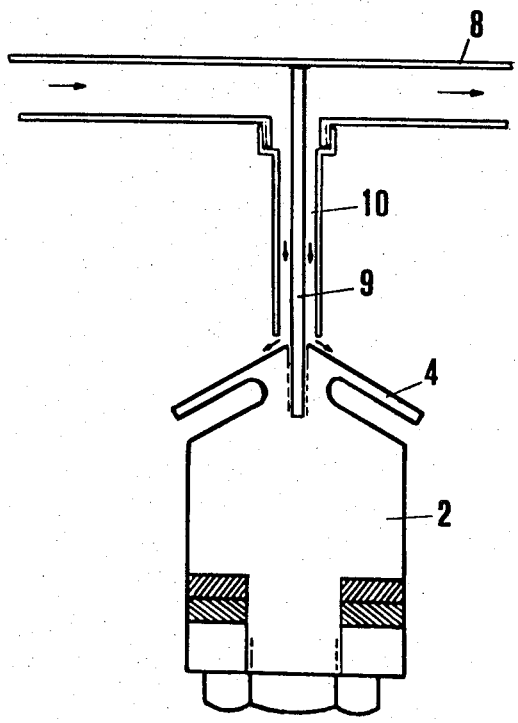
FIG. 7 shows a way of fixing the apparatus shown in FIG. 6.

The embodiment shown in FIG. 6 can be secured in a simple manner to mounting means 8. For this purpose, as shown in FIG. 7, the tip of the cone is provided with a bore through which mounting member 9 (for example, a pin, tube, wire or the like) is passed. In this case liquid delivery means 10 can be disposed concentrically around mounting member 9. Other alternative forms of the atomizer of this invention can also be fixed in a similar manner. Fixed support means 8 can also be a liquid supply conduit from which the liquid is passed through passage 10 into the region of the tip of the cone.

In the apparatus shown in FIG. 8*a* and FIG. 8*b*, conical resonator 4 is secured by means of its tip and by means of coupling portion 7, respectively, to excitation system 2 so that this mode of coupling represents a reversal of the embodiments referred to at the beginning of this description. In FIG. 8*a* the liquid is supplied by way of annular nozzle arrangement 11 which is mounted around coupling portion 7 of the resonator, that is, in the transitional region between resonator 4 and excitation system 2. However, the liquid can also be delivered into the region of the nodal point in any other manner, for example, through axial bore 12 in the excitation system with lateral outlet openings at the surface of the cone, that is, in the region of the transition to resonator 4, as shown in FIG. 8*b*.

Figure 9:
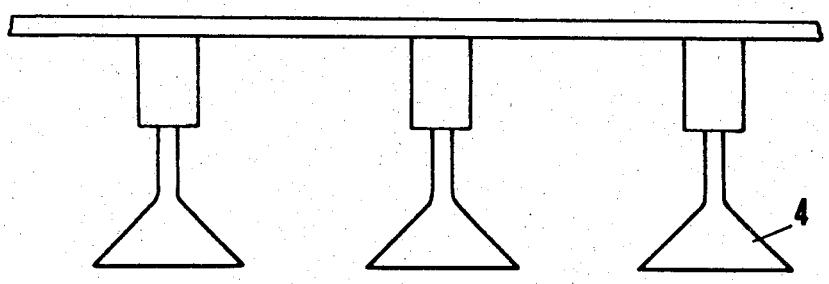
FIG. 9 shows a linear arrangement of a plurality of atomizers wherein the bending resonators are in the form of hollow cones in reversed positions.

FIG. 9 shows that a plurality of atomizers, as shown in FIGS. 8*a* and 8*b*, can be secured to a common liquid supply conduit. Other kinds of arrangements, for example, circular arrangements, can also be used. Such an embodiment is particularly suitable for high rates of liquid through-put.

Figure 10:
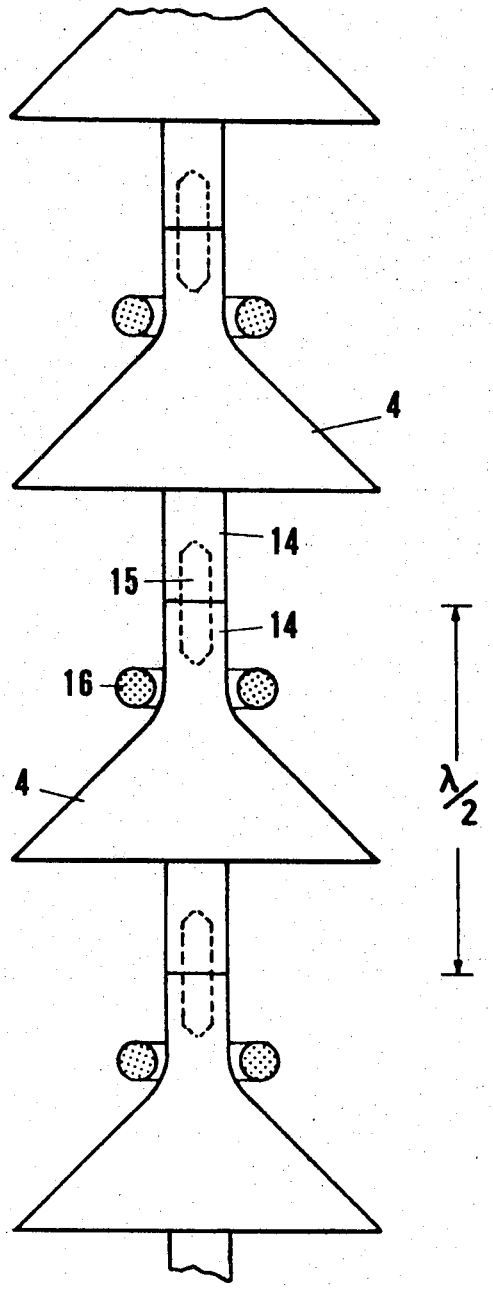
FIG. 10 shows a plurality of conical bending resonators which are connected together in a cascade formation, with a common excitation system.

However, the bending resonators can also be connected together in a cascade formation and jointly excited. This embodiment is shown in diagrammatic form in FIG. 10. The elements of the cascade comprise conical bending resonators 4 with coupling portions 14, which are identical from the point of view of material and dimensions. The overall length of an element of the cascade formation is λ/2 and the elements of the cascade formation are each connected together at the speed antinodes, for example, by screws 15. The individual elements of the cascade formation can also be secured together by soldering or by any other suitable means. In another alternative form the cascade formation is produced in one piece. The excitation system (not shown herein) which is common to the elements of the cascade formation can be disposed both above and also below the cascade formation. The supply of liquid can be effected in the manner already described hereinbefore. In this case, coupling portions 14 in the region of the transition to the tip of the respective cone are provided with annular pipe 16 which includes liquid discharge openings.

Figure 11:
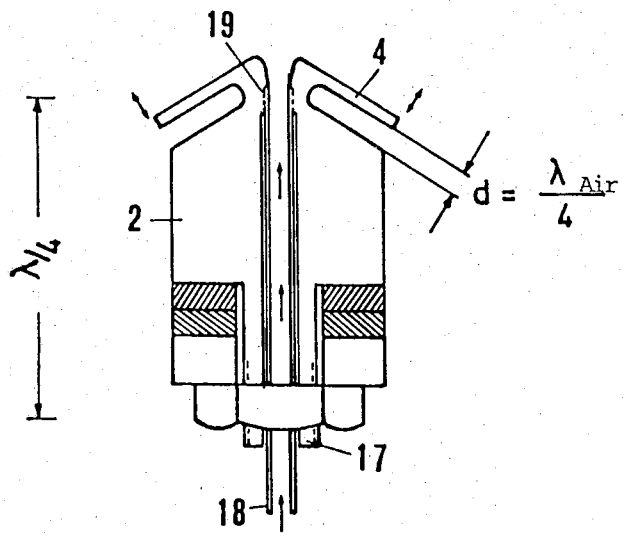
FIG. 11 shows an atomizer with a conical bending resonator with liquid supply through the center from the back side.

The λ/4-construction with conical bending resonator, as shown in FIG. 11, but which is described in greater detail in FIG. 6, is particularly suitable for use in oil burners because of the manner in which the liquid is supplied. Excitation system 2 has axial bore 17 which extends to the tip of resonator 4. Tube 18, which is tuned to resonance, is passed through bore 17 and is fixedly anchored to the system, for example, by screw means 19, in the velocity nodal region. The opening at the tip of the resonator is somewhat rounded in order to provide for optimum distribution on the surface of the cone of the liquid, which is passed through tube 18 and which issues at the tip of the cone.

Figure 12:
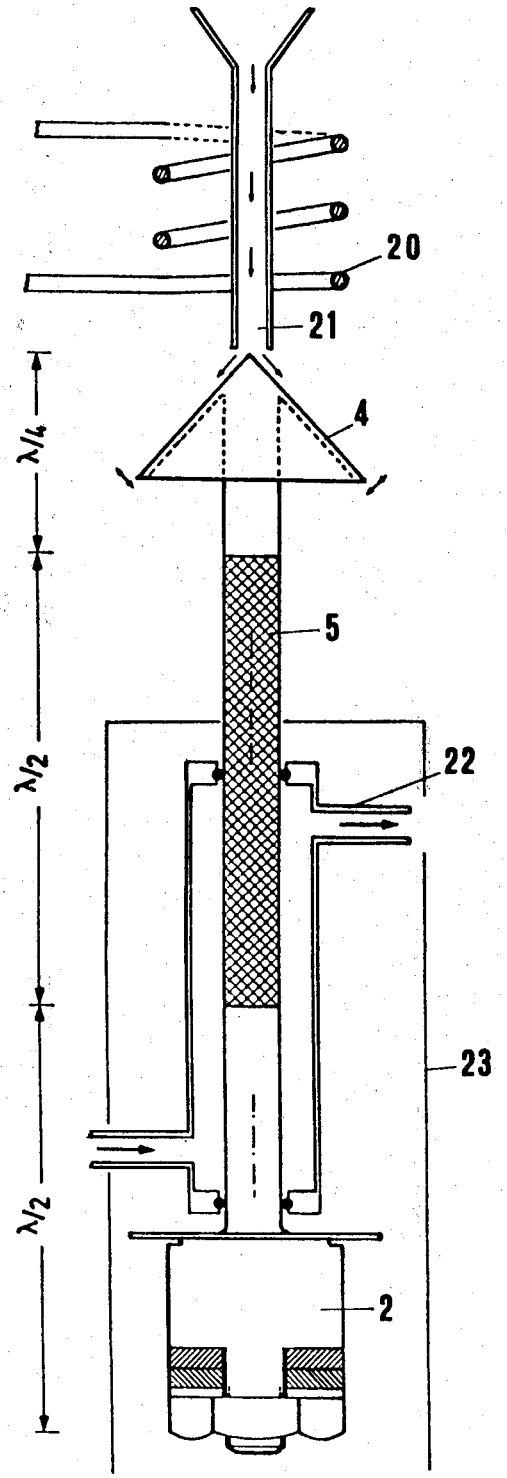
FIG. 12 shows an embodiment with heating and cooling means, which is suitable for the atomization of metal melts.

FIG. 12 shows an embodiment wherein resonator 4 is heated and the temperature-sensitive parts of excitation system 2 are cooled.

Heating is effected for example by means of induction coil 20 through which melt 21 is passed. Cooling is effected between two adjacent velocity nodal regions of slender portion 5. For that purpose such region can be provided, for example, concentrically with liquid- or gas- cooling means 22. The cooling section is preferably disposed at the lower region of slender portion 5. Cooling section 22 and excitation system 2 can also be provided with casing 23 to prevent any possibility of overheating having a detrimental effect.

Figure 13:
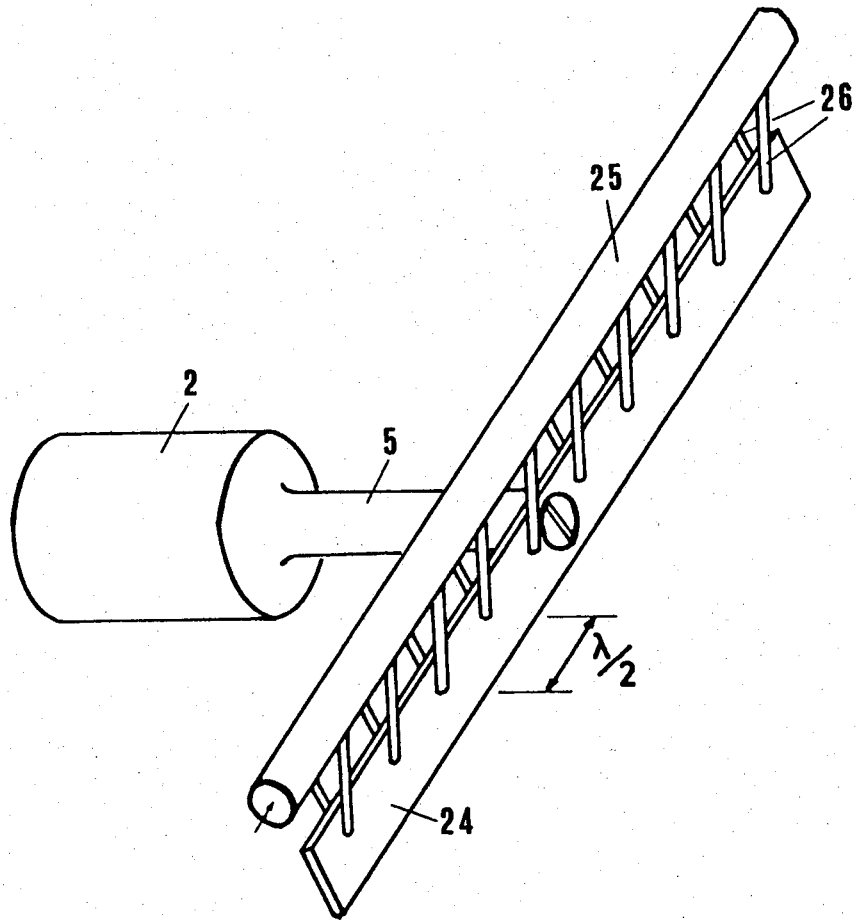
FIG. 13 shows an atomizer according to this invention wherein the bending resonator is in the form of a narrow metal strip.

FIG. 3 shows an atomizer of this invention, wherein the bending resonator is in the form of an elongated thin metal strip 24. Strip 24 is connected to excitation system 2, 3 in the antinode. The atomization surfaces of strip 24 are disposed perpendicularly to the axis of excitation system and 3. By varying the axial direction of the excitation system, which extends horizontally in the form illustrated, the normal of the surface of strip 24 and, thus the direction of atomization, can be set at any desired angle of inclination. When axially excited such a strip produces bending oscillations, wherein the nodal lines extend parallel to each other on the atomization surface and perpendicular to the excitation axis. The liquid can be supplied by way of supply conduit 25 which is provided with liquid supply pipes 26 on both sides, in the region of the nodal lines. The liquid can also be supplied on one side, or only some nodal lines may be supplied with liquid. The liquid which flows along the nodal lines spreads out laterally of the nodal line towards the antinode, with the film of liquid decreasing in thickness—thus the liquid is atomized. Instead of by axial excitation, the bending oscillation of the resonator can also be produced by means of torsional excitation. Such a construction is shown in FIGS. 14*a* and 14*b*. Strip 24, which is also of an elongated, narrow form, is connected to excitation system 2 by way of a spiral member 27. In this arrangement the normal of the surface of strip 24 is perpendicular to the axis of excitation system 2. In general, for torsional excitation, it is sufficient for the narrow cylindrical portion of the excitation system to be only partly provided with a spiral member. The direction of atomization is horizontal with respect to the axis of the excitation system so that the excitation system is not detrimentally affected when atomization occurs. In this embodiment the liquid can be supplied in a similar manner to the supply of liquid for the linear atomizer shown in FIG. 13; various other forms of liquid supply arrangement are described hereinafter with reference to FIGS. 16 and 17.

Figure 15:
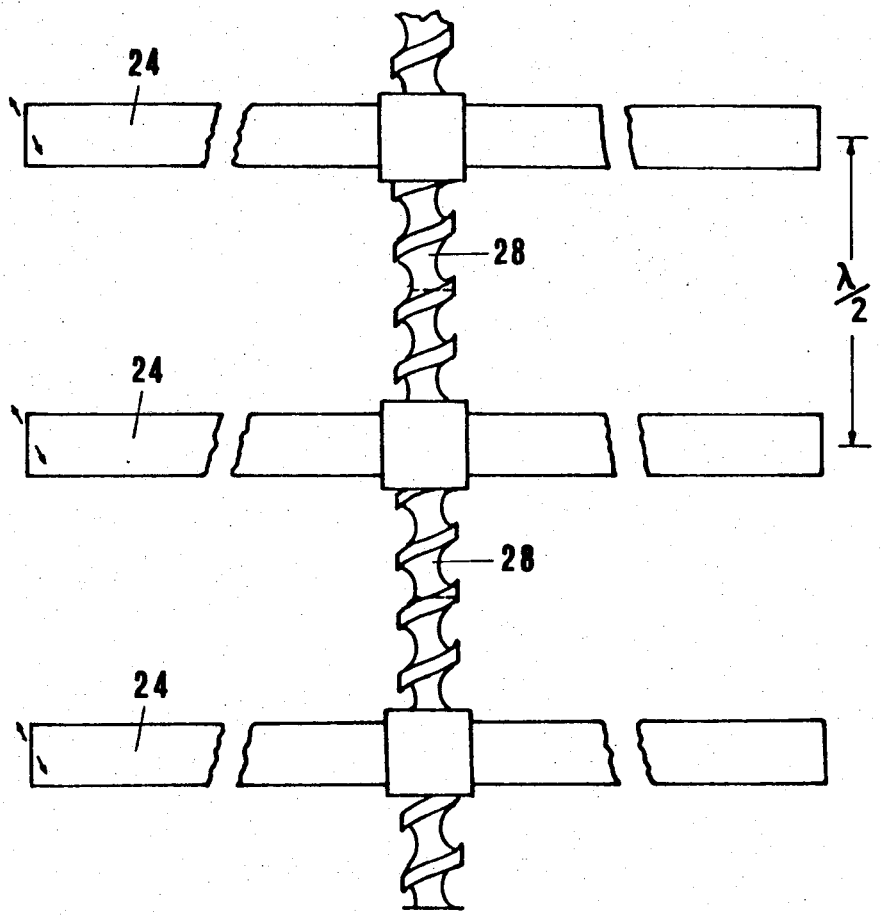
FIG. 15 shows a plurality of atomizers as shown in FIGS. 2*a* and 2*b*, connected together in a cascade formation.

FIG. 15 shows a cascade-like arrangement of linear bending resonators 24. The individual elements of the cascade formation, of length λ/2 (in the axial direction), which comprise bending resonator 24 and spiral coupling portions 28, are secured together at the torsional speed antinodes. The axial excitation system (not shown herein), which is common to all the elements of the cascade formation, can be disposed above or below the cascade formation. In general it is not necessary for each section of the cascade formation to include spiral members. Also a cascade arrangement can be used which has the construction shown in FIG. 13—although in such case there is no torsional excitation, so the spiral members are not necessary. In a further embodiment the bending strips, which are arranged in the cascade formation, can be disposed at different angular positions relative to each other.

Figure 16A:
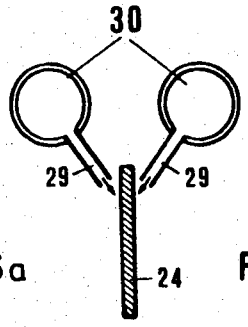
FIGS. 16*a* through *g* shows various forms of the liquid delivery means.
Figure 16B:
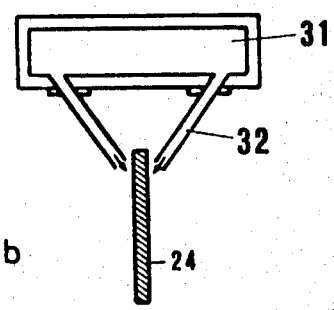
Figure 16C:
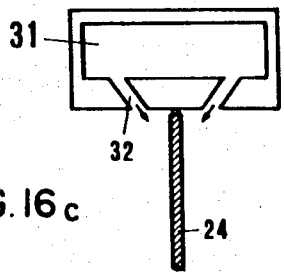

Referring to FIG. 16*a*, it will be seen that strip 24 can be supplied with liquid on both sides along the nodal line, by way of branch pipes 29, from supply conduits 30. Liquid can also be supplied in this manner from liquid reservoir 31 with suitable openings 32, as shown in diagrammatic form in FIGS. 16*b* and 16*c*.

Figure 16D:
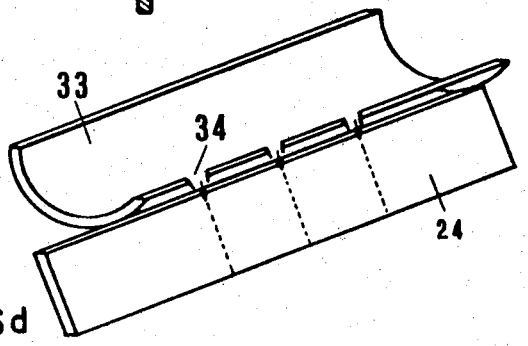
Figure 16E:
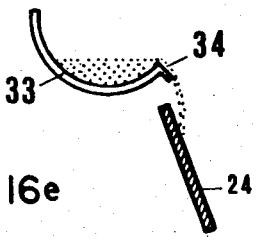

In cases where there is a danger of blockage of the pipes carrying the liquid, it may be appropriate to use semicylindrical container 33 with suitable openings or accessory members 34 for supplying the liquid—openings or elements 34 being arranged in the region of the velocity notes at a spacing of λ/2. These embodiments are shown in FIGS. 16*d* and 16*e*.

Figure 16F:
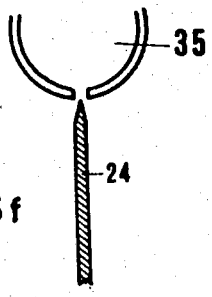
Figure 16G:
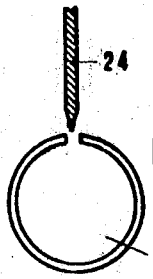

In the embodiment shown in FIG. 16*f*, strip-like resonator 24 is taken directly to the opening in supply conduit 35. In this arrangement the liquid is distributed to the atomization surfaces, starting from the velocity nodes. In the embodiment shown in FIG. 16*g* the liquid is sucked up along the nodal lines from reservoir 35 during the oscillatory movement. In this case the outlet openings of the supply conduit can be relatively large without the problem of releasing more liquid than can be supplied by the pump. The danger of blocked openings by particles suspended in the liquid is considerably reduced.

Figure 17:
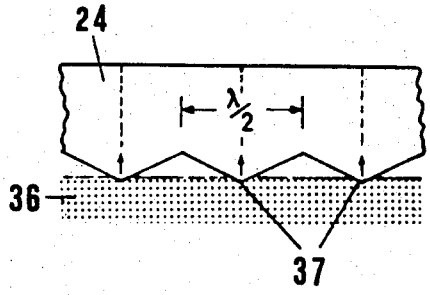
FIG. 17 shows a further form of the liquid delivery means.

FIG. 17 shows another manner of supplying the liquid for resonators of strip-like nature. In this arrangement the lower edge of bending resonator 24 dips into liquid reservoir 36 at the velocity nodes. For this purpose the lower edge of resonator 24 of this embodiment is provided with scallop-like projections 37 at a spacing of $\lambda/2$. The liquid is then transferred onto the atomization surface by an acoustic pumping action. Instead of scallop-like projections, projections of any suitable form can be used.

What is claimed is:

1. Apparatus for atomizing liquids comprising an ultrasonic excitation system, a bending resonator which oscillates at ultrasonic frequencies, and means for the delivery of liquid into the velocity nodal region of the bending resonator, characterized in that the bending resonator has at least one surface which is outwardly and downwardly inclined with respect to the axis of the excitation system and has a tip, that the flow axis of the liquid delivery means is approximately parallel to the axis of the excitation system, and that the length of the excitation system is approximately $(2n+1)\lambda/4$, wherein n is 0 or an integer.

2. Apparatus as claimed in claim 1 wherein the bending resonator is in the form of a hollow cone.

3. Apparatus as claimed in claim 1 wherein the bending resonator is in the form of a hollow pyramid.

4. Apparatus as claimed in claim 1 wherein the bending resonator has two surfaces which are at an angle relative to each other and the liquid can be supplied along the edge at which the surfaces intersect.

5. Apparatus as claimed in claim 3 or claim 4 wherein a heating means for the resonator is provided for atomization of melts, wherein the axial excitation system has a cylindrical cylinder portion that has two adjacent velocity regions and wherein a cooling section is provided between the two adjacent velocity nodal regions of the cylindrical slender portion of the axial excitation system.

6. Apparatus as claimed in claim 1 wherein the liquid to be atomized can be delivered axially in a jet on to the tip of the resonator.

7. Apparatus for atomizing liquids comprising an ultrasonic excitation system, a bending resonator which oscillates at ultrasonic frequencies, and means for the delivery of liquid into the velocity nodal region of the bending resonator, characterized in that the bending resonator has at least one surface which is inclined with respect to the axis of the excitation system and has a tip, that the length of the axial excitation system is approximately $(2n+1)\lambda/4$, wherein n is 0 or an integer, that the axial excitation system has a cylindrical slender portion that has two adjacent velocity nodal regions, that a heating means for the resonator is provided for atomization of melts, and that a cooling section is provided between the two adjacent velocity nodal regions of the cylindrical slender portion of the axial excitation system.

8. Apparatus as claimed in claim 7 wherein the bending resonator is in the form of a hollow cone.

9. Apparatus as claimed in claim 8 wherein the length of the excitation system is $\lambda/4$ and wherein the bending resonator is formed by a narrow aperture in the cylindrical portion of the excitation system.

10. Apparatus as claimed in claim 9 wherein in that the width of the aperture is $(2n+1)\lambda_{air}/4$, where n is 0 or an integer.

11. Apparatus as claimed in claim 7 wherein the bending resonator is in the form of a hollow pyramid.

12. Apparatus as claimed in claim 7 wherein the bending resonator has two surfaces which are at an angle relative to each other and the liquid can be supplied along the edge at which the surfaces intersect.

13. Apparatus as claimed in claim 11 or claim 12 wherein the resonators are arranged in a cascade formation and wherein the resonators in the cascade formation are arranged at different angular positions relative to each other.

14. Apparatus as claimed in claim 7 wherein the resonator is an induction coil.

15. Apparatus as claimed in claim 14 wherein the liquid to be atomized can be delivered axially in a jet on to the tip of the resonator.

16. Apparatus as claimed in claim 7 wherein, for the purposes of delivery of the liquid, the excitation system has an axial bore, wherein a tube, which is tuned to resonance, is passed through the axial bore and secured to the resonator in the velocity nodal region, and wherein the tip of the bending resonator is rounded off in the region of the opening.

17. Apparatus as claimed in claim 16 wherein the tip of the bending resonator is provided with a bore and is fixed by means of a mounting member, and wherein the liquid delivery means is disposed concentrically around the mounting member.

18. Apparatus as claimed in claim 17 wherein the cylindrical slender portion of the excitation system fits onto the tip of the resonator from the outside.

19. Apparatus as claimed in claim 17 wherein, for the delivery of the liquid, the excitation system has an axial bore which is provided with liquid outlet opening in the transitional zone between the excitation system and the resonator.

20. Apparatus as claimed in claim 19 wherein, for the delivery of the liquid, an annular pipe is provided in the transitional zone between the resonator and the excitation system, the annular pipe having a plurality of liquid outlet openings.

21. Apparatus for atomizing liquids comprising an ultrasonic excitation system, a bending resonator which oscillates at ultrasonic frequencies, and means for the delivery of liquid into the speed nodal regions of the bending resonator, characterized in that the bending resonator is in the form of an elongated narrow strip having a plurality of parallel nodal lines, that the normal to the surface of the resonator, and thus the atomization direction, is perpendicular to the axis of the excitation system, and that the excitation system has a slender cylindrical portion which is at least partly in the form of a spiral so that the axial oscillation of the excitation system is converted into a torsional component.

22. Apparatus as claimed in claim 21 wherein liquid delivery means to the nodal lines are provided on both sides of the resonator.

23. Apparatus as claimed in claim 23 wherein an edge of the bending resonator is provided, at the velocity nodes, with extension portions which dip into a liquid reservoir so that the liquid is transferred onto the resonator surface for atomization thereof, by an acoustic pump effect.

24. Apparatus as claimed in claim 23 wherein a plurality of atomizers are secured to a common liquid supply conduit.

25. Apparatus as claimed in claim 24 wherein a plurality of identical bending resonators with a common excitation system are connected together in a cascade-type formation and wherein the cascade elements are coupled in the velocity antinodes or torsional velocity antinodes.

26. Apparatus as claimed in claim 25 wherein each section of the cascade formation includes spiral elements.

27. Apparatus as claimed in claim 24 wherein the plurality of atomizers are in a linear arrangement.

28. Apparatus as claimed in claim 24 wherein the plurality of atomizers are in a circular arrangement.

29. Apparatus for atomizing liquids comprising an ultrasonic excitation system, a bending resonator which oscillates at ultrasonic frequencies, and means for the delivery of liquid into the velocity nodal region of the bending resonator, characterized in that the excitation system has a cylindrical portion, that the bending resonator has at least one surface which is inclined with respect to the axis of the excitation system, that the bending resonator is in the form of a hollow cone, that the bending resonator is formed by a narrow aperture in the cylindrical portion of the excitation system, and that the length of the excitation system is $\lambda/4$.

30. Apparatus as claimed in claim 29 wherein in that the width of the aperture is $(2n+1)\ \lambda_{air}/4$, wherein n is 0 or an integer.

31. Apparatus for atomizing liquids comprising an ultrasonic excitation system, a bending resonator which oscillates at ultrasonic frequencies, and means for the delivery of liquid into the velocity nodal region of the bending resonator, characterized in that the bending resonator has at least one surface which is inclined with respect to the axis of the excitation system, that the length of the excitation system is approximately $(2n+1)\ \lambda/4$, where n is 0 or an integer, that, for the purposes of delivery of the liquid, the excitation system has an axial bore, that a tube, which is tuned to resonance, is passed through the axial bore and secured to the resonator in the velocity nodal region, and that the bending resonator has a tip which is rounded off in the region of the opening.

32. Apparatus for atomizing liquids comprising an ultrasonic excitation system, a bending resonator which oscillates at ultrasonic frequencies, and means for the delivery of liquid into the velocity nodal region of the bending resonator, characterized in that the bending resonator has at least one surface which is outwardly and downwardly inclined with respect to the longitudinal axis of the excitation system, that the flow of the liquid as delivered is approximately parallel to the longitudinal axis of the excitation system, and that the length of the excitation system is approximately $(2n+1)\ \lambda/4$, wherein n is 0 or an integer.

33. Apparatus as claimed in claim 32 wherein said flow of liquid as delivered is cylindrical shaped, said cylinder of liquid flow as delivered being approximately parallel to said longitudinal axis of said excitation system, and surrounds the transitional zone between said excitation system and said bending resonator.

34. Apparatus as claimed in claim 32 wherein the axis of said flow of liquid as delivered is approximately parallel to said longitudinal axis of said excitation system.

* * * * *